United States Patent [19]

Korthaus

[11] Patent Number: 4,818,192

[45] Date of Patent: Apr. 4, 1989

[54] RECIPROCATING PUMP

[76] Inventor: Ernst Korthaus, Sonnenstrasse 112, 4600 Dortmund 1, Fed. Rep. of Germany

[21] Appl. No.: 679,040

[22] PCT Filed: Apr. 3, 1984

[86] PCT No.: PCT/EP84/00093

§ 371 Date: Nov. 30, 1984

§ 102(e) Date: Nov. 30, 1984

[87] PCT Pub. No.: WO84/03914

PCT Pub. Date: Oct. 11, 1984

[30] Foreign Application Priority Data

Apr. 6, 1983 [DE] Fed. Rep. of Germany ..... 3312357
Mar. 24, 1984 [DE] Fed. Rep. of Germany ..... 3410911

[51] Int. Cl.[4] ..... F04B 21/00

[52] U.S. Cl. ..... 417/372; 417/400; 92/144

[58] Field of Search ..... 417/400, 404, 372, 401, 417/402, 403, 468, 469; 92/85 B, 144, 108, 113

[56] References Cited

U.S. PATENT DOCUMENTS

| | | | |
|---|---|---|---|
| 129,631 | 7/1872 | Waring | 92/144 |
| 255,116 | 3/1882 | Rand | 92/144 |
| 363,453 | 5/1887 | Ford | 92/144 X |
| 1,647,425 | 11/1927 | Wise | 417/404 X |
| 1,689,049 | 10/1928 | Prosser | 92/144 X |
| 2,751,144 | 6/1956 | Troendle | 417/404 |
| 3,248,023 | 4/1966 | Dienenthal | 417/400 X |
| 3,913,460 | 10/1975 | Wright | 92/85 R |

*Primary Examiner*—Leonard E. Smith
*Attorney, Agent, or Firm*—Mueller and Smith

[57] ABSTRACT

The invention concerns a reciprocating pump whose plunger (10) is connected with a plunger rod (12) that runs in a stuffing box (13) coordinated with the pump cylinder (9) cap and is reciprocated hydraulically, where the cylindrical walls of the pump cylinder (9) are provided, over their entire length, with flow-through openings for a cooling medium passing through them, and the flow-through openings in the cylindrical walls of the pump cylinder (9) are connected to a coolant circuit. To make such a pump safe to run dry, especially in pumping solid-laden fluids, and avoid burning of the packings (11, 13*a*) of plunger (10) and stuffing box (13) while preventing hydraulic fluid from proceeding into the pump cylinder (9), the invention suggests sealing the plunger (10) relative to the pump cylinder (9) through packings (11), providing the plunger rod (12) with flow-through openings (12*c*, 12*d*) for a medium to pass through, connecting the flow-through openings (12*c*, 12d) in the plunger rod (12) to a common hydraulic circuit (~) , and using the medium for the hydraulic cylinder likewise as cooling medium.

7 Claims, 3 Drawing Sheets

RECIPROCATING PUMP

Figure 1:
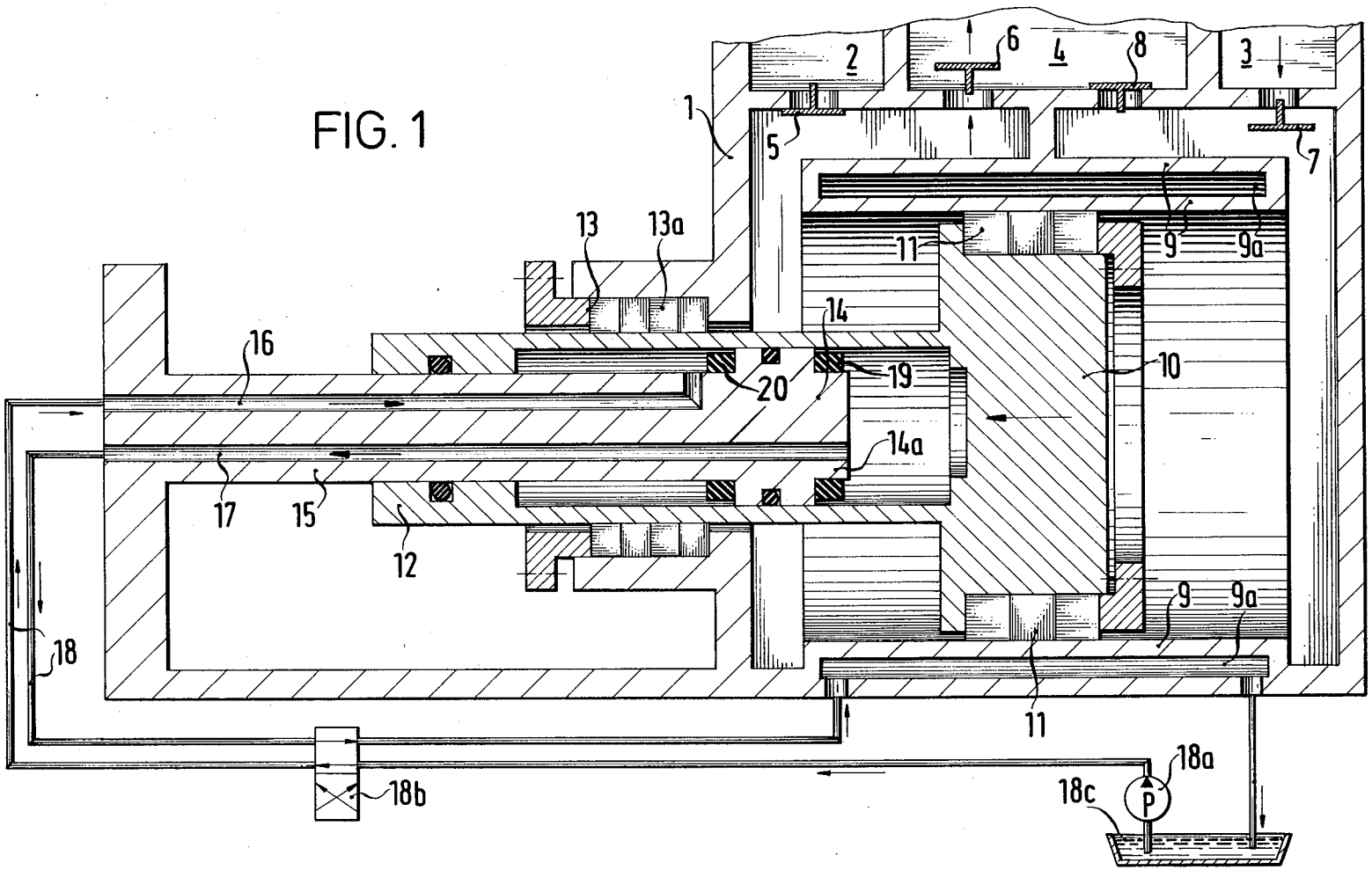

The invention concerns a reciprocating pump whose plunger is connected with a plunger rod which runs in a stuffing box coordinated with the pump cylinder cap and is hydraulically reciprocated, where the cylindrical walls of the pump cylinder are provided, over their entire length, with flow-through openings for a cooling medium passing through them, and the flow-through openings in the cylindrical walls of the pump cylinder are connected to a coolant circuit.

A problem associated with that type of reciprocating pumps is making them safe to run dry. Dry running of the pump involves the danger that the packings in the area of the plunger and stuffing box will overheat and burn, especially when relatively high sealing pressures are required.

Known from the U.S. Pat. No. 2,751,144 is a gas compression apparatus which, as a reciprocating compressor with piston rings, is driven hydraulically. For continuous dissipation of the compression heat of the gas, the hydraulic fluid, after passing through the hydraulic drive, proceeds through the compressor housing, which is provided with cooling chambers. The problem of temporary dry running does not occur with such a gas compressor.

Previously known from the Belgian patent document No. 423 910 is a mechanically driven reciprocating gas compressor which has a dual-stage design and is double-acting in the first stage. The heat generated through the gas compression is dissipated through hollow spaces in the cylinder, piston, and the hollow piston rod by a cooling medium flowing through these. Concerned here, too, is a gas compressor with piston rings where the problem of a temporary dry running is nonexistent.

Since reciprocating fluid pumps require generally no cooling, no teaching transferable to the problem underlying the invention can be derived from the above state of the art.

Deriving from the German patent publication No. 23 34 245 is a power water generator with commercial grade seals for its hydraulic drive. This power water generator features neither stuffing box packings nor is it suited for pumping fluids which contain solids.

Therefore, the problem underlying the invention is advancing the reciprocating pump of the initially mentioned type, with stuffing boxes, to the effect that in pumping solid-laden fluids it will be safe to run dry over long periods of time, without permitting hydraulic fluid to proceed into the pump cylinder.

Basing on a plunger rod of the initially mentioned type, the invention suggests to solve the problem by sealing the plunger against the pump cylinder with the aid of packings, providing the rod with flow-through openings for a medium to pass through, connecting the flow-through openings in the rod to a common hydraulic circuit, and using the hydraulic medium likewise as cooling medium.

The inventionally suggested cooling of the plunger rod and cylindrical walls of the pump cylinder results in a continuous direct cooling of the packing sealing faces which are in contact with the plunger rod and/or the cylindrical walls of the pump cylinder, so that the packing material cannot burn even when the pump runs dry. The coolant in the flow-through openings being encapsulated relative to the interior of the pump cylinder, no coolant can proceed into said interior. Being good heat conductors, the metallic walls between the friction faces and the coolant can dissipate the heat generated by dry running of the reciprocating pump considerably faster than can the poorly heat-conductive packing material.

Moreover, special advantages result from the fact that a separate coolant circuit is no longer necessary. In this case present anyway, the hydraulic circuit is rather used for cooling.

The flow-through openings in the plunger rod and the cylindrical walls of the pump cylinder are suitably connected to a common coolant circuit. Thus it is possible to favorably make do with only one coolant circuit.

Particular advantages result when the reciprocating pump is driven by a hydraulic cylinder and the hydraulic working medium for the drive cylinder is likewise the cooling medium. This inventional design of the reciprocating pump requires no longer a separate coolant circuit. Available in this case anyway, the hydraulic circuit is rather used for cooling.

A suitable embodiment of the inventional reciprocating pump provides for a hollow design of the plunger rod and for likewise utilizing it as the cylinder part of the hydraulic drive, which is mounted shiftably on the stationary ram and the drive rod connected with it. In addition to a continuous cooling of the plunger rod, this offers the advantage of a particularly short overall length, making it possible to give the entire pump aggregate including drive a very compact design. Another significant advantage is that the outside of the plunger rod, with this design, makes no longer contact with the hydraulic drive medium, thus eliminating the danger of hydraulic drive medium migrating into the pump cylinder. Especially this design, therefore, is suited for foodstuff pumping.

To avoid with the latter design flexible pressure medium connections, a further provision consists in feeding the hydraulic drive medium to the hydraulic drive cylinder via the stationary ram rod and the stationary ram, these two being provided with appropriate feed bores.

Since the latter design involves relatively large reciprocating masses, the fixed ram is on both end faces suitably provided with shock absorbers for limit position damping. Avoided thereby are jolting blows when reaching the limit positions.

The shock absorbers consist suitably of rubber rings which bear, inside, on the driving ram rod and/or a corresponding cylindrical extension on the solid face of the driving ram while leaving toward the inside wall of the cylinder part of the drive cylinder an annular space with a definitive volume which, while the rubber rings undergo deformation as they strike the ends of the cylinder part, fill up with rubber substance which upon complete filling of the annular gap becomes practically inelastic. Such shock absorbers are simple in design and practically nonwearing. Kinematically reversed, of course, the rubber rings may as well be provided on the ends of the cylinder part while leaving open, toward the driving ram rod, an appropriate annular space of definitive volume.

According to another inventional design of the reciprocating pump, the plunger rod of the pump cylinder is at the same time the ram rod of the drive cylinder, the cylinder part of the latter being fixed and accommodating in axially shiftable fashion the drive ram connected with its rod, where the rod consists of an external pipe and an internal pipe arranged concentrically in the former and spaced radially from it, and where the hydraulic drive medium flows at least during part of the stroke through the annular space between the external and the internal pipe.

This inventional design of the reciprocal pump offers over the first design the advantage that the drive ram may have a diameter of arbitrary size permitting the admission of greater drive forces.

In order to make the hydraulic working medium of the hydraulic cylinder flow through the common plunger rod at least during part of the driving stroke, the driving ram rod features at an axial spacing from the ram a second ram, the interior of the internal pipe connects with the annular space between both rams, the annular space between internal and external pipe of the driving ram rod connects directly beside the second ram with the annular space between the cylinder part and the ram, the wall of the cylindrical part of the hydraulic cylinder is provided with two pressure medium sockets which are connected with a common pressure medium line, the axial spacing of the sockets corresponding with the axial length of the second ram, while the spacing between the hydraulic cylinder cap and the first pressure medium socket is smaller or equal to the axial spacing between the two drive rams. The particular advantage of this measure is that a quantity of hydraulic working medium which is sufficient for cooling can be fed to the common rod of drive ram and pump plunger, without requiring the provision of a pressure medium connection which moves along with the rod.

An embodiment of the invention will be more fully explained hereafter with the aid of the drawing.

Figure 2:
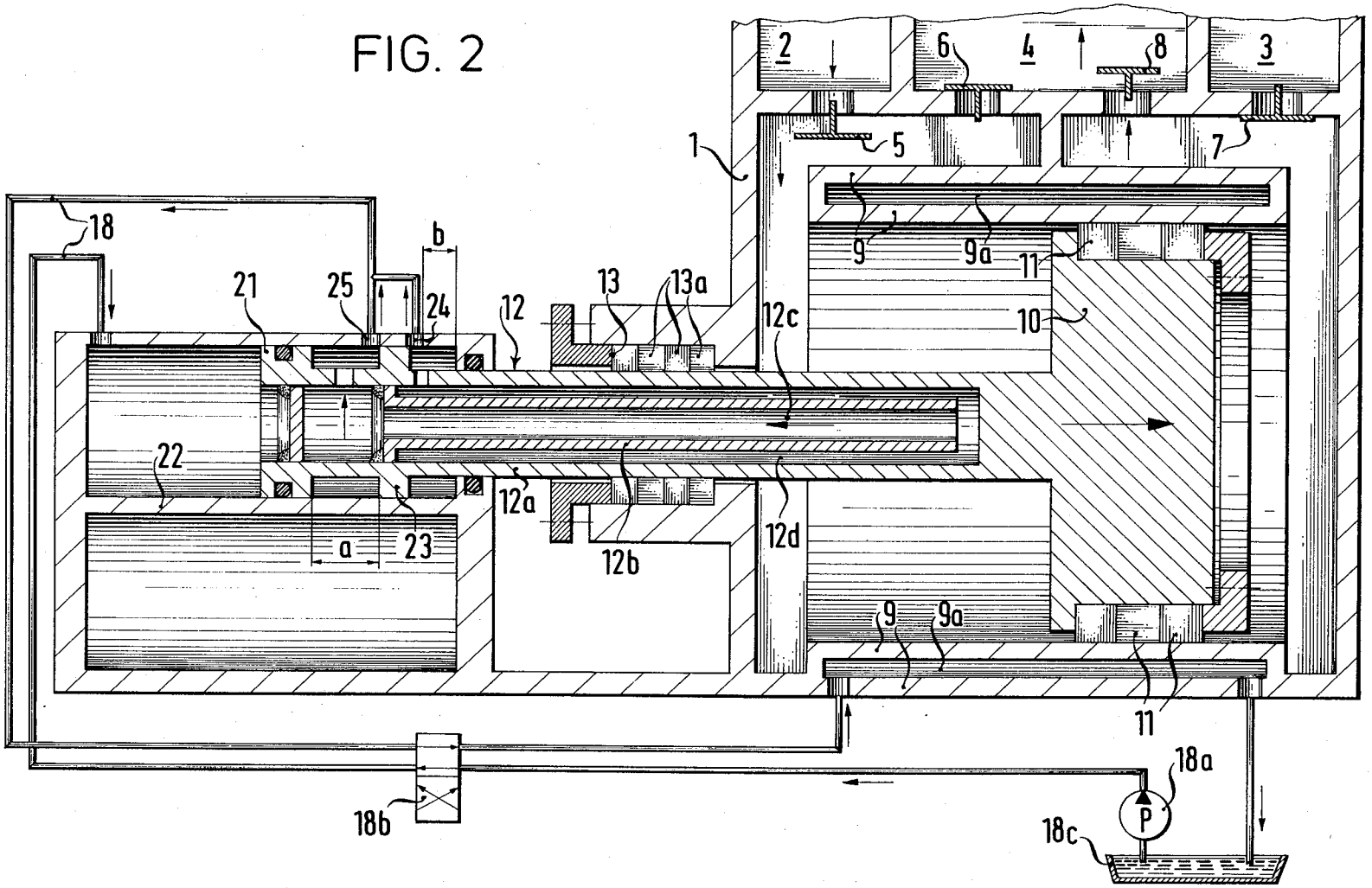
Figure 3:
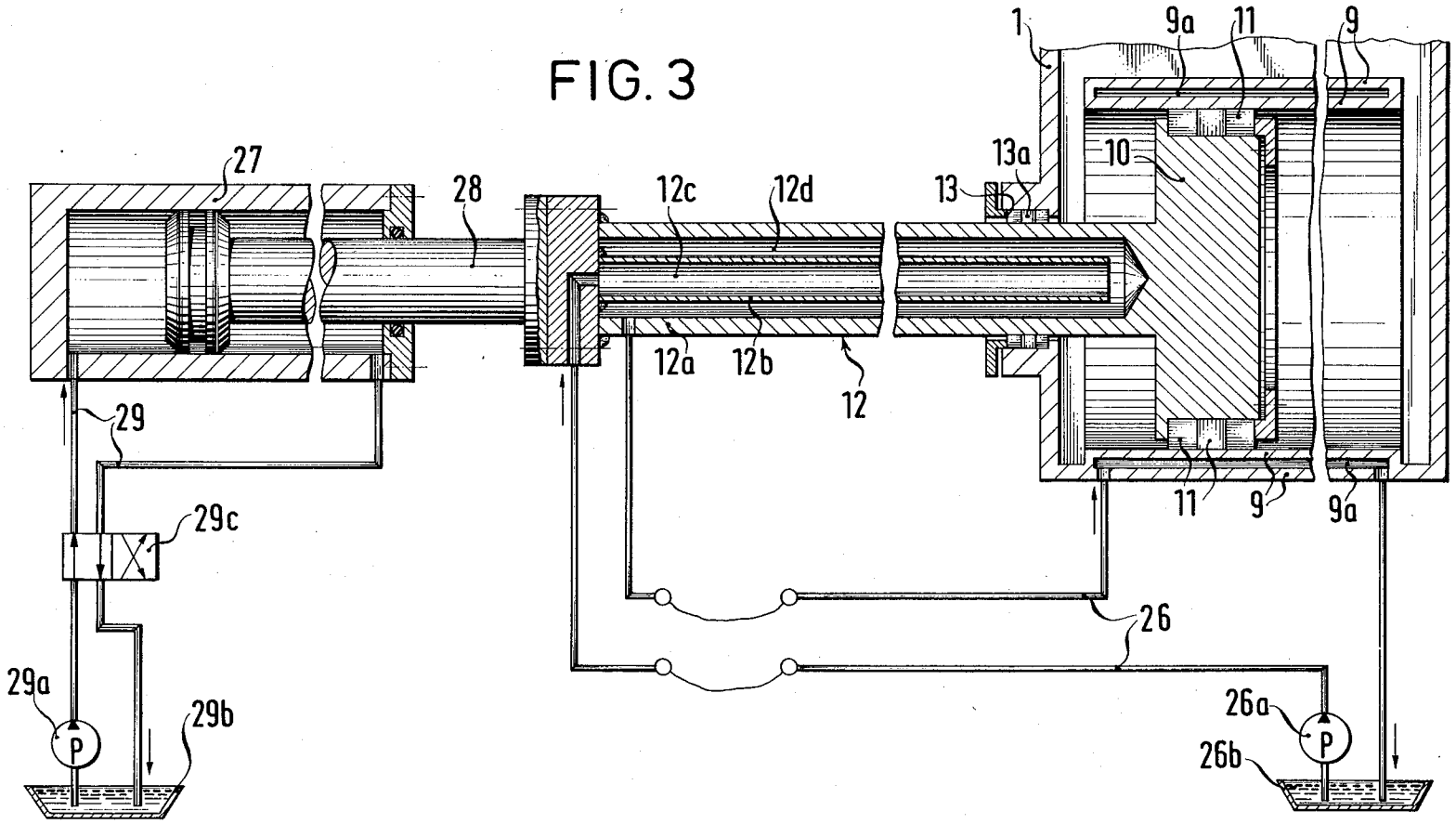

FIG. 1 shows a horizontal section of an inventional reciprocating pump in a first design;

FIG. 2, a horizontal section of an inventional reciprocating pump in a second design;

FIG. 3, a horizontal section of an inventional reciprocating pump in a third design.

In FIG. 1, the reciprocating pump housing is marked 1 and features two intake chambers 2 and 3 as well as a pressure chamber 4 which connects through check valves 5 and 6 and/or 7 and 8 with the one and/or the other end of the pump cylinder 9.

A double-acting plunger 10 reciprocates in the pump cylinder 9. Ring-shaped packings 11 provide a seal between the plunger 10 and the inside wall of the pump cylinder 9. The packings 11 consists preferably of a self-lubricating material capable of running dry. The cylindrical walls of the pump cylinder 9 are provided with flow-through openings 9*a* for a coolant passing through them, the openings extending over the entire axial length.

Attached to the plunger 10 is a plunger rod 12 passing through a stuffing box 13. The plunger rod 12 is hollow and accommodates inside a fixed drive ram 14 which is connected with an as well fixed ram rod 15. The hollow plunger rod 12 runs on the fixed drive ram 14 and its as well fixed ram rod 15, forming together with it the double-acting drive cylinder 12, 14, 15 whose cylinder part (plunger rod 12) is axially shiftable. Bores 16 and 17 in the fixed ram rod 15 and the fixed ram 14 serve the alternating hydraulic medium admission to the pressure spaces of the drive cylinder 12, 14, 15.

The hydraulic drive medium is supplied by a hydraulic circuit 18 featuring a pump 18*a*, reversing valve 18*b*, and a reservoir 18*c*. This hydraulic circuit 18 includes the flow-through openings 9*a* in the cylindrical walls of the pump cylinder 9, the bores 16 and 17, and the pressure spaces of the drive cylinder 12, 14, 15. Thus, the hydraulic medium cools both the cylindrical walls of the pump cylinder 9 and the plunger rod 12 across their entire length, dissipating continuously and intensively the heat generated on the friction faces of the packings 11 and/or 13*a*. This continuous cooling prevents a burning of the packings, even when running dry for a longer time. The inventional pump is thus absolutely safe to run dry.

To effect a limit position damping of the relatively heavy reciprocating plunger rod 12, the two end faces of the fixed ram 14 are provided with rubber rings 19 and 20 which contact the outer circumference of the drive ram rod 15 and/or a corresponding cylindrical extension 14*a* of the ram 14 while leaving toward the inside wall of the plunger rod 12 (cylinder part of the hydraulic cylinder 12, 14, 15) an annular gap with an exactly defined volume. As the fixed ram 14 strikes the inside ends of the hollow space of the axially moving plunger rod 12, these rubber rings undergo an elastic deformation until they completely fill the annular gap and form a practically inelastic pad. Realized thereby is a highly effective and practically nonwearing end position damping at relatively low expense.

As far as the parts are concerned which pertain to the pump housing and plunger 10, the embodiment according to FIG. 2 corresponds entirely with the embodiment according to FIG. 1, for which reason identical designators are used for identical parts. But the rod 12 of the plunger 10 serves here at the same time as rod of the hydraulic cylinder and connects therefore with a double-acting ram 21 which is mounted in axially shiftable fashion in a fixed cylinder component 22. To effect here as well a cooling of the plunger rod over its entire length, by the medium of the hydraulic cylinder 22, 21, 12, the plunger rod 12 consists of an external pipe 12*a* and an internal pipe 12*b* which are nested concentrically at a radial spacing. Thus the internal space 12*c* of the internal pipe 12*b* and the annular space 12*d* between external pipe 12*a* internal pipe 12*b* form a flow-through opening through which passes the hydraulic medium successively, thereby cooling the plunger rod 12 as required.

For feeding the hydraulic medium to the plunger rod 12 while avoiding moving pressure medium connections, the plunger rod 12 features a second drive ram 23 which is axially spaced from the ram 21. Moreover, the internal space of the internal pipe 12*b* is with the annular space between the two rams 21 and 23 in a connection suited for hydraulic medium conveyance. The annular space between the external pipe 12*a* and the internal pipe 12*b* connects as well, directly beside the second ram 23, with the annular space between the plunger rod 12 and the cylinder component 21 of the hydraulic cylinder 22, 21, 12. Lastly, the wall of the cylinder component 22 of the hydraulic cylinder 22, 21, 12 features two parallel pressure medium connections 24 and 25 which are connected to the pressure medium circuit 18 and whose axial spacing equals the axial length of the second ram 23. The space b between the cap of the hydraulic cylinder 22, 21, 12 and the first pressure medium connection 24 is smaller than or at the most equal to the axial spacing a between the two rams 21 and 23.

As follows from FIG. 2, the hydraulic medium contained before the second ram 23 is forced into the annular space between the external pipe 12*a* and the internal pipe 12*b* as the plunger rod 12 shifts to the right, and proceeds then through the internal pipe 12*b* into the annular space between the two rams 21 and 23 and thence through the pressure medium connection 25 into the pressure medium circuit 18. In converse admission, the hydraulic medium flows first as well through the plunger rod 12 and cools it.

As regards the design of the pump cylinder 9, plunger 10, and rod 12, the embodiment according to FIG. 3 is identical with that according to FIG. 2, using same designators for identical components.

The plunger rod 12 consists as well of an external pipe 12*a* and an internal pipe 12*b* which nest concentrically while maintaining a radial spacing. The internal space 12*c* of the internal pipe 12 and the annular space 12*d* between external pipe 12*a* and internal pipe 12*b* form flow-through openings for a cooling medium which is fed into the plunger rod 12 from a separate coolant circuit 26. In addition, this separate coolant circuit 26 includes the flow-through openings 9*a* in the cylindrical walls of the pump cylinder 9. Moreover, the separate coolant circuit 26 comprises a coolant pump 26*a* and reservoir 26*b*.

The plunger 10 of the embodiment according to FIG. 3 is driven by a separate hydraulic cylinder 27 whose rod 28 is attached to the outer end of the plunger rod 12. The pressure medium for the separate hydraulic cylinder 27 is supplied by a separate hydraulic circuit 29 comprising a hydraulic pump 29*a*, reservoir 29*b*, and reversing valve 29*c*. The hydraulic cylinder 27, facultatively, may be substituted also by another drive aggregate which effects the reciprocating movement of the plunger rod 12.

I claim:

1. A double-acting reciprocating pump for liquids which pump can operate dry without overheating, which comprises:

a hydraulically-driven plunger disposed within a pump cylinder for reciprocating movement therein, said plunger having plunger packings disposed between said plunger and said pump cylinder, said pump cylinder having flow-through openings in communication with a coolant circuit to cool said plunger packings;

a plunger rod connected to said plunger which rod passes through a stuffing box and is sealed from said pump cylinder by stuffing box packings, said plunger rod having at least one hollow space which is in connection with said coolant circuit to cool said stuffing box packings.

2. The pump of claim 1 wherein said plunger rod is hollow; a fixed drive ram is disposed within said hollow plunger rod for forming a second drive cylinder with said hollow plunger rod, the hollow space within said hollow plunger rod being in communication with a hydraulic medium for driving said hydraulically-driven plunger.

3. The pump of claim 2 wherein said hydraulic medium also serves as the coolant in said coolant circuit.

4. The pump of claim 3 wherein the hydraulic medium is fed into said hollow plunger through feed bores which are provided in said fixed drive ram.

5. The pump of claim 4 wherein both end faces of said fixed drive ring are provided with shock absorbers for limit position dampening.

6. The pump of claim 1 wherein said plunger rod is hollow and is connected to said plunger at one end and is terminated by a ram at the other end; said pump further comprising a hollow fixed cylinder component in which is disposed said plunger rod and ram for forming a second drive cylinder which is operable by said hydraulic medium for hydraulically-driving said hydraulically-driven plunger.

7. The pump of claim 6 wherein the hydraulic medium which drives said second drive cylinder also is said coolant in said coolant circuit.

* * * * *